United States Patent [19]

Jones

[11] Patent Number: 4,824,614

[45] Date of Patent: Apr. 25, 1989

[54] DEVICE FOR UNIFORMLY DISTRIBUTING A TWO-PHASE FLUID

[75] Inventor: Jeffrey A. Jones, Keene, Calif.

[73] Assignee: Santa Fe Energy Company, Santa Fe Springs, Calif.

[21] Appl. No.: 36,331

[22] Filed: Apr. 9, 1987

[51] Int. Cl.[4] ..... B01F 3/04

[52] U.S. Cl. ..... 261/76; 138/37; 138/39; 366/337; 366/338

[58] Field of Search ..... 366/336, 184, 337, 338, 366/340; 138/37, 39; 48/189.4; 261/76, 78.1, 78.2; 166/250, 57, 303, 64, 272

[56] References Cited

U.S. PATENT DOCUMENTS

| | | | |
|---|---|---|---|
| 172,117 | 1/1876 | Hardy | 138/37 |
| 1,816,412 | 7/1931 | Tipton | 48/189.4 |
| 2,094,948 | 10/1937 | Hurley | 366/336 |
| 2,126,364 | 8/1938 | Witzel | 62/126 |
| 2,164,011 | 6/1939 | Hilborn | 47/2 |
| 3,068,904 | 12/1962 | Moody | 138/37 |
| 3,090,603 | 5/1963 | Johnson | 138/37 X |
| 3,406,947 | 10/1968 | Harder | 259/4 |
| 3,682,443 | 8/1972 | Upmeier | 259/4 |
| 3,923,288 | 12/1975 | King | 259/4 |
| 4,208,136 | 6/1980 | King | 366/338 |
| 4,220,416 | 9/1980 | Brauner et al. | 366/337 |
| 4,396,063 | 8/1983 | Godbey | 166/250 |
| 4,505,297 | 3/1985 | Leech III et al. | 137/561 A |
| 4,574,837 | 3/1986 | Aggour | 138/37 X |

FOREIGN PATENT DOCUMENTS

| | | | |
|---|---|---|---|
| 10504 | 2/1906 | United Kingdom | 138/37 |

OTHER PUBLICATIONS

Two-Phase Flow Splitting at a Pipe Tee by K. C. Hong, Journal of Petroleum Technology, Feb. 1978, pp. 290–296.

*Primary Examiner*—Harvey C. Hornsby
*Assistant Examiner*—K. L. O'Leary
*Attorney, Agent, or Firm*—Frederick E. Mueller

[57] ABSTRACT

A flow splitting junction of a pipeline network for a two-phase fluid is internally fitted with a static mixer, a multi-duct stratifier and a divider wall. The turbulent fluid exhausted from the mixer is separated by the stratifier into two separated sets of alternating laminarly flowing strata to be discharged to opposite sides of the divider wall as two separate fluid streams of the same gas-liquid ratio which are conducted into separate downstream branches of the junction.

3 Claims, 3 Drawing Sheets

DEVICE FOR UNIFORMLY DISTRIBUTING A TWO-PHASE FLUID

BACKGROUND OF THE INVENTION

The present invention relates generally to the distribution of two-phase fluids through pipeline networks comprising a header or manifold which supplies the fluid to a plurality of branch lines. More particularly, the invention relates to an apparatus which mixes, stratifies and divides a flowing two-phase fluid in such manner that each branch of a pipeline network will receive a quantity of the two-phase fluid having a gas-to-liquid ratio (GLR) which is substantially the same as the gas-liquid ratio of the source of the two-phase fluid.

There are many instances in which it is desired to distribute a mixture of a gas and a liquid to multiple end users or points of use from a single source of generation of the two-phase fluid. Such applications would include, for example, oil field pipelines, refinery networks, gas distribution lines carrying small amounts of condensate, and oil field steam injection pipeline networks carrying steam of less than 100% quality. Pipeline networks commonly use standard side branch pipe Tees to accomplish the splitting of a fraction of the flowing two-phase fluid out of the manifold or header into a branch line. It has long been known that the GLR of a two-phase fluid usually changes during splitting through such Tees because the liquid and gas phases tend to split in different proportions. Thus, in some pipeline networks as the amount of gas phase of the two-phase fluid entering the side branch of the Tee exceeds about 15% of the input gas phase a disproportionately greater portion of the liquid phase of the input fluid is diverted into the side branch of the Tee fitting.

One prior art approach to the problem involves a modification of the geometry of the pipeline network such that each Tee is oriented in a "dead end split" manner wherein the side arm, i.e. the stem of the Tee, comprises the upstream end of the Tee junction while the two coaxial arms of the head of the Tee comprise the split downstream ends of the junction. In this case, when 15% to 85% of the gas enters one of the two downstream branches, the liquid stream splits in substantially the same proportion as the gas, giving the same GLR downstream and upstream. Outside this range, however, almost all liquid enters the branch receiving most of the gas. A very great disadvantage of this dead end split Tee arrangement is that it yields a geometry of pipeline network utilizing excessive lineal feet of piping as contrasted to a geometry of pipeline network wherein a single trunk distribution line header supplies relatively short branch feeder lines in an arrangement wherein each branch line is connected to the stem of a Tee fitting while the head of the Tee is joined as an integral straight-through section of the single trunk distribution line.

In another prior art approach a pipeline network has been devised utilizing Wye fittings arranged such that the upstream end of the fitting comprises the stem of the Wye and a so-called motionless or static mixer is positioned immediately upstream of the stem of the Wye. Additionally, the stem of the Wye is fitted with a blade member for immediately splitting the two-phase fluid from the motionless mixer into two separate streams that pass through the divergent output legs of the Wye fitting. However, as in the case of the network utilizing dead end split Tees, this latter approach also yields a relatively expensive geometry of pipeline network. Additionally, notwithstanding the combination of a static mixer with a divider wall, it has been found that this arrangement does not provide equal quality distribution or splitting of the two-phase fluid over a useful range.

SUMMARY OF THE INVENTION

The present invention provides an apparatus for the uniform splitting of the flow of a two-phase fluid at every junction of a pipeline distribution network such that the gas-liquid ratio of the fraction of the source fluid diverted into every branch line is substantially the same as the gas-liquid ratio of the fluid produced at the source. The apparatus consists of the combination of an upstream end static mixer, followed by a static stratifier that, in turn, is immediately succeeded by a divider wall that segregates the product of the static mixer and stratifier into a pair of isolated streams. This apparatus is useable with virtually any geometry or configuration of pipeline network such as those, e.g., wherein the flow splitting junctions are defined by dead end split Tees, or side branch Tees, or Wye fittings. Irrespective of the type of flow splitting plumbing fitting which is employed, the invention may be employed in pipeline network geometries in which, while the main manifold distribution lines is substantially horizontally disposed, the branch lines may incline upwardly or downwardly relative to the main line as well as horizontally. However, as contrasted to previously available alternatives, the invention is highly advantageous in uniformly splitting a two-phase fluid in an economical pipeline network comprising a single trunk distribution line and standard Tees arranged in a manner such that the side arm branch or stem of each Tee communicates with a branch line.

DESCRIPTION OF THE PREFERRED EMBODIMENT

Figure 1:
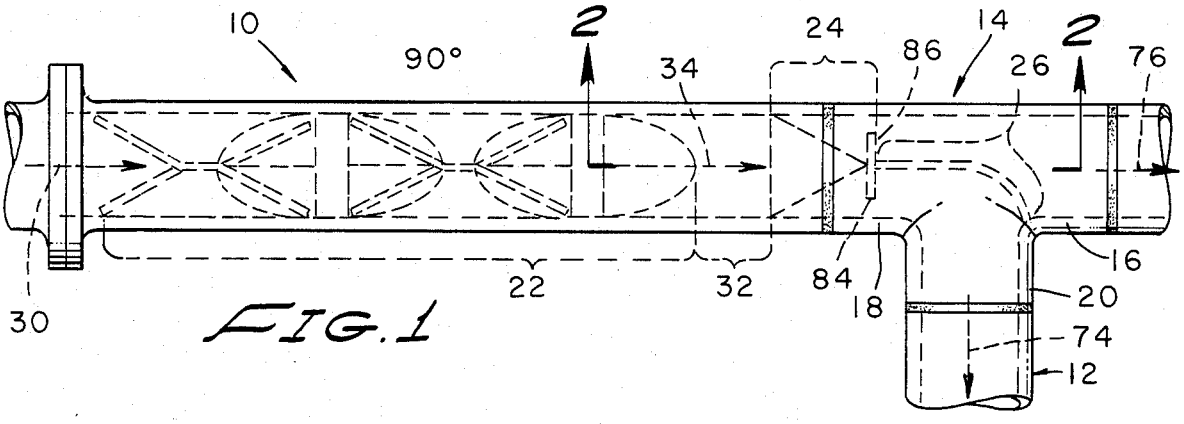
FIG. 1 is a plan view of a portion of a pipeline network having a branch line and showing, in phantom outline, the positions of the mixer, stratifier and divider wall components of the invention relative, to the branch line.

FIG. 1 shows a portion of a pipeline distribution network comprising a main distribution trunk line designated generally by the numeral 10 and a lateral branch line 12. The lateral line 12 is connected in fluid communication with the main line 10 by means of a standard Tee fitting 14 whose head comprises a coaxially aligned pair of oppositely extending branches 16 and 18 on opposite sides of a side arm branch 20. The head of the Tee fitting 14 thus comprises an integral part of the main line 10. While not fully illustrated, it will be understood that the main line 10 is of indeterminate length and is made up of a serially interconnected series of lengths of pipe and at spaced points along its length is provided with a series of the Tee fittings 14 each of which is in fluid communication with its own lateral line 12. It will also be understood that the upstream end of the trunk line 10 is connected to a source of a particular two-phase fluid of interest which is pumped through the network at a desired rate and pressure for delivery to the several ultimate end points of use connected to the downstream ends of the lateral lines 12.

At each junction of the main line 10 with a lateral line 12, the pipeline network is internally equipped with the apparatus of this invention. More specifically, the apparatus comprises, within the main line 10, a mixing means 20 immediately upstream of a stratifier means 22 and a divider wall 24 extending from a midline of the downstream end of the stratifier means 24 to the downstream side of the junction between the side branch 20 and downstream arm 16 of the Tee fitting 14.

The mixing means 22 can be any of several different kinds of so-called static mixers which are characterized in that they have no moving parts, will not induce excessive pressure drops in the two-phase fluid passing therethrough, and will induce homogenization of the two-phase fluid. For purposes of this invention, the mixing means 22 is one which spans the full cross-sectional area of the conduit or pipe in which it is positioned; divides the full stream of heterogeneous two-phase fluid into a plurality of individual streams; one which, in dividing the fluid streams, introduces complex rotational and/or radial vectors to the particles of the gas and liquid; and recombines the individual streams in a mutually interpenetrating manner so that mixing and homogeneity are induced. Examples of this class of static mixer are shown in Harder U.S. Pat. No. 3,406,947, King U.S. Pat. No. 3,923,288 and Brauner, et al., U.S. Pat. No. 4,220,416, the disclosures of which are incorporated herein by reference. The presently preferred form of static mixer is that of the King patent which, accordingly, has been schematically indicated in the drawings.

Figures 7, 9:
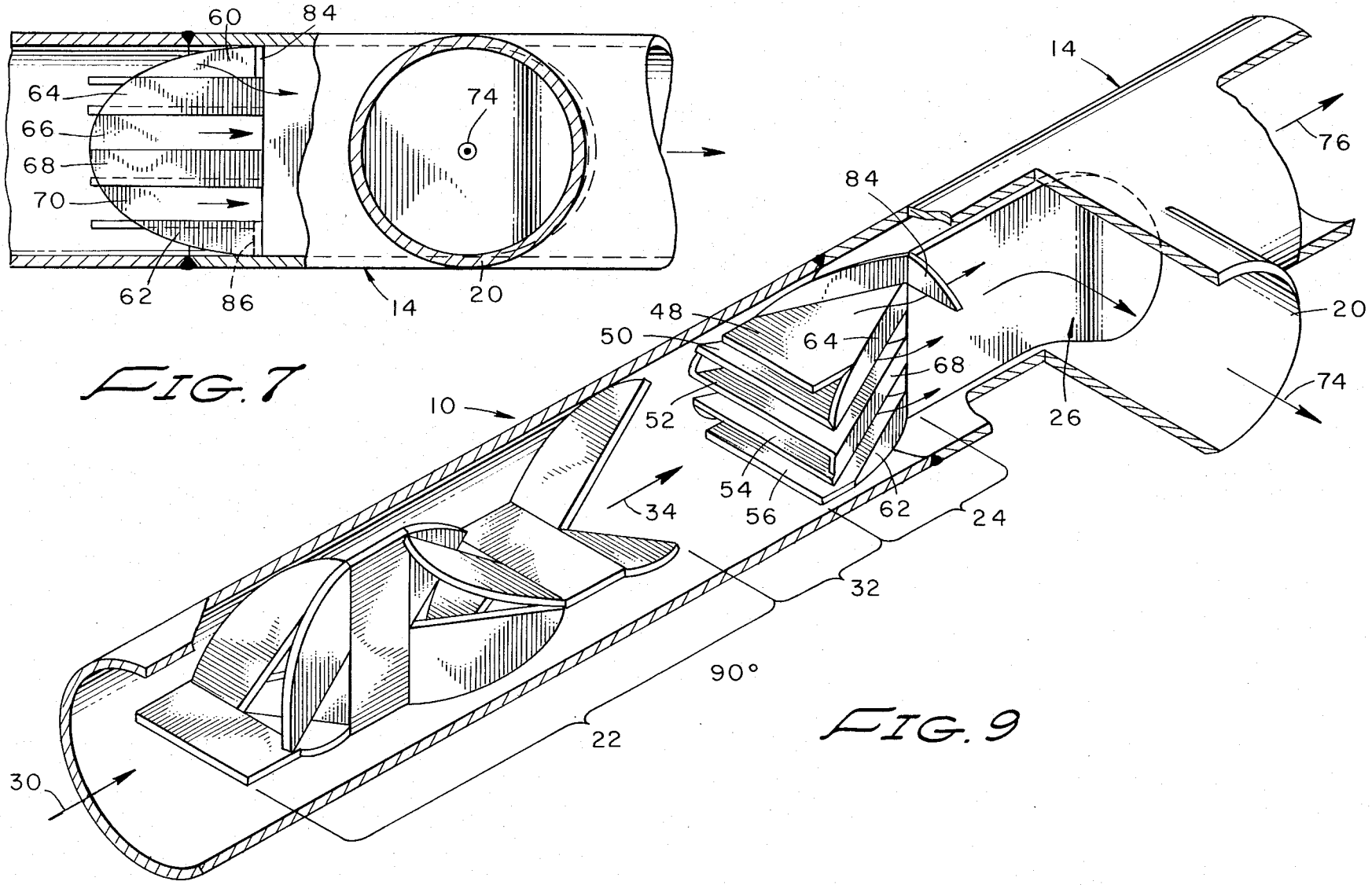
FIG. 7 is a section taken on the line 7—7 of FIG. 3.
FIG. 9 is a partially cut-away perspective view of the invention.

Referring to FIGS. 1 and 9, the directional arrow 30 represents the upstream or incoming mass flow of the particular two-phase fluid of interest immediately upstream of the mixing means 22. Almost invariably the incoming fluid 30 will not be a homogeneous mixture of the gas and liquid phases thereof. Experience shows that after leaving its source virtually any two-phase fluid originally having a substantially continuous gas phase quickly separates into separate gas and liquid streams and/or slugs such that it would be virtually impossible to maintain a uniform GLR when the mass of the two-phase fluid is split in any form of plumbing fixture. The mixing means 22 spans the entire cross-sectional area of the main line 10 and is securely held in place against axial displacement. This may be accomplished, for example, by means of brazing peripheral portions of the particular device employed onto the internal surface of the pipe. In any event, as the mass flow 30 of the incoming heterogeneous two-phase fluid passes through the mixing means 22, it is divided into a plurality of individual streams and the device has surfaces which in dividing the stream introduce complex axial, rotational and/or radial vectors to the particles of the individual streams. The individual streams are then recombined in a mutually interpenetrating manner so that mixing is induced. The cycle is preferably repeated.

The downstream end of the mixing means 22 may be spaced from the upstream end of the stratifier means 24 by a zone or gap 32 which preferably has an axial length of no more than one pipe diameter. The directional arrow 34 within the gap 32 represents the axial flow vector of the mutually interpenetrating individual streams of fluid exhausting from the downstream end of the mixing means 22 although, in some cases, even without the zone 32, sufficient mixing of the gas and liquid phases of the fluid will occur. On the other hand, the zone 32, if present, should not be of a length such that the fluid will resegregate into separate phases of gas and liquid.

The exhaust stream 34 has strong dynamic signals which appear to be the resultant of the rotational and radial vectors induced by the mixing means 22 such that, without the presence downstream of the stratifier means 24, a disproportionate amount of the liquid phase of the fluid would enter the side arm branch 20 of the Tee 14 notwithstanding the presence of the divider wall 26. Stated otherwise, the nature of a static mixer which works by dividing and recombining the two-phase fluid is such that it induces a strong dynamic signal for the liquid phase to go in one direction or the other. Accordingly, the stratifier means 24 is interposed, between the downstream end of the mixing means 22 and the upstream end of the divider wall 26, to divide the flow 34 into a multiplicity of alternating strata.

As used in this specification, a stratifier means denotes a device to divide the turbulent mass flow 34 of two-phase fluid exhausted by the mixing means 22 into a multiplicity of separate strata of the fluid, the multiple strata comprising two sets of strata each of which comprises spaced apart multiple strata, and to then induce a laminar flow in each such stratum in a ducting arrangement such that the two sets of strata are exhausted from the stratifier device as two separate sets.

Figure 8:
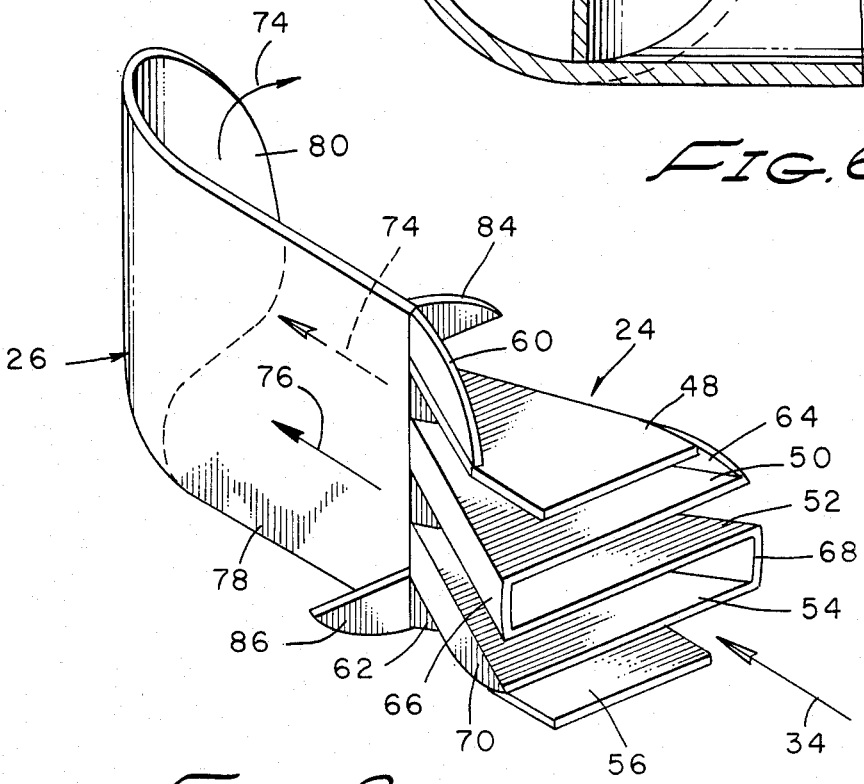
FIG. 8 is a perspective view of the stratifier and divider wall components of the invention.

As shown in the drawings, the presently preferred form of stratifier means 24 takes the form of a multi-duct structure which is constructed of a thin sheet material. As indicated in FIG. 8, the stratifier may be fabricated integrally with the divider wall 26 as a sub-assembly independent of the mixing means 22.

Figure 2:
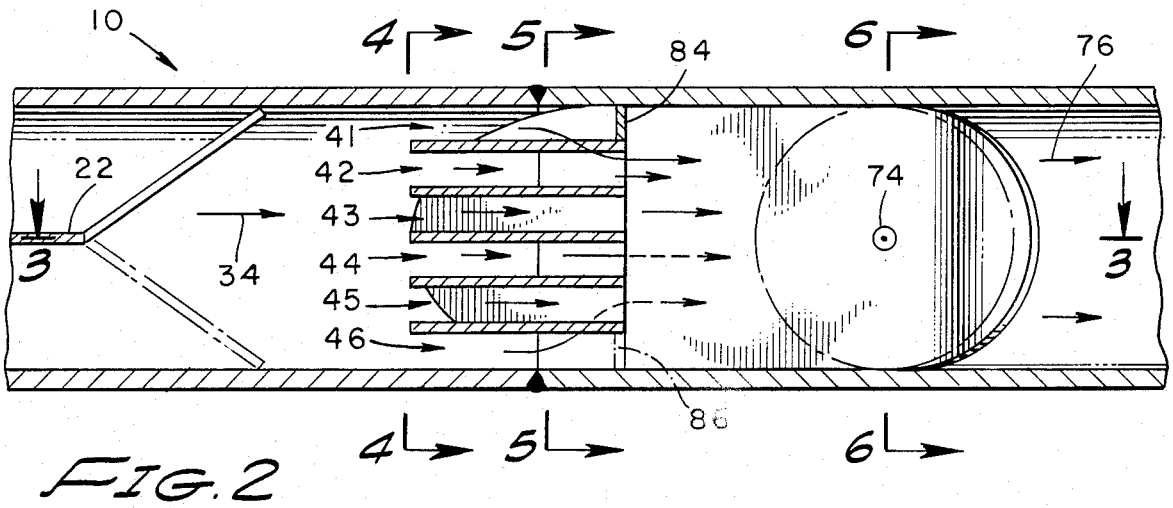
FIG. 2 is a sectional view taken on the line 2—2 of FIG. 1.
Figure 3:
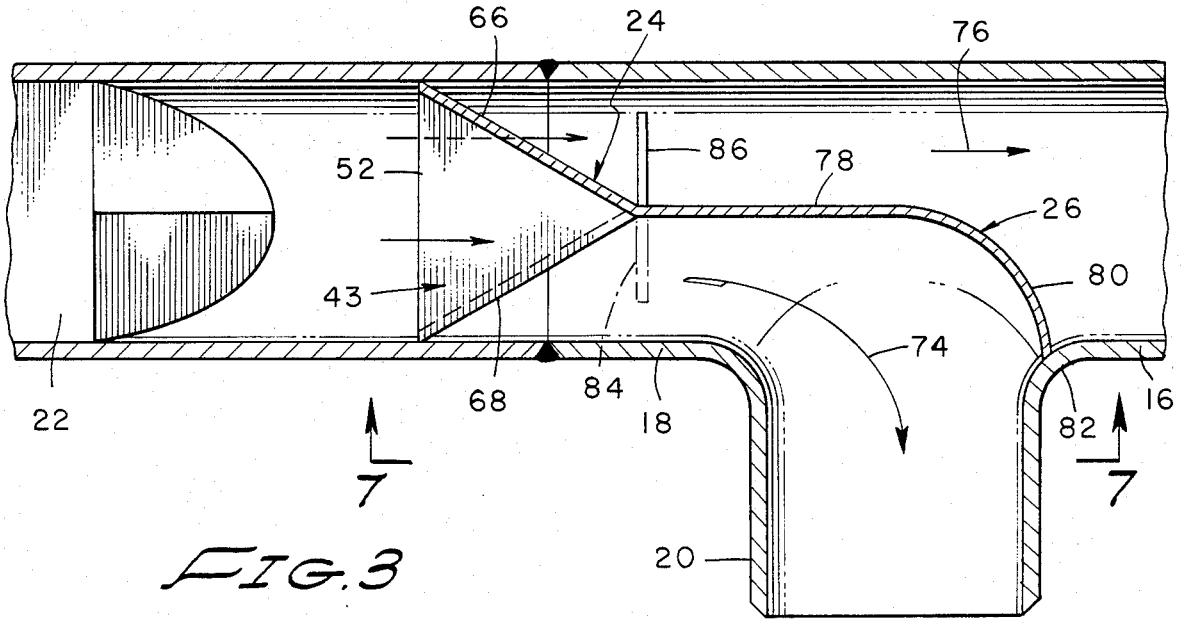
FIG. 3 is a sectional view taken on the line 3—3 of FIG. 2.
Figure 4:
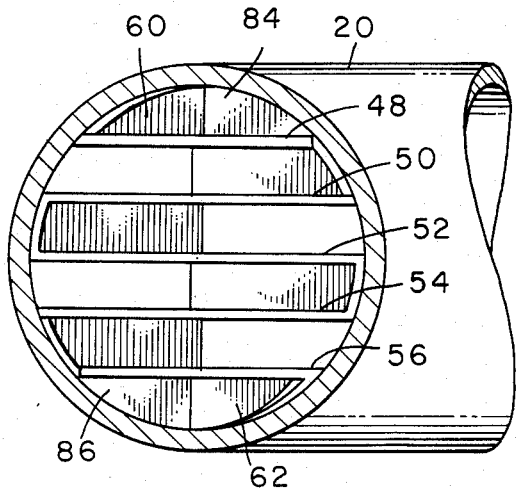
FIG. 4 is a sectional view taken on the line 4—4 of FIG. 2 particularly showing the upstream or entrance end of the stratifier stage of the invention.

As shown in FIG. 2, when the stratifier means is fixed in place in the main line 10, e.g., by brazing, it defines a vertically stacked array of a multiplicity of individual ducts having their axes horizontally aligned with the flow axis of the pipe. In the illustrated case the stratifier structure defines six ducts 41–46 which are isolated from one another in the vertical direction by vertically spaced apart horizontally disposed plates 48, 50, 52, 54 and 56. All of the plates are substantially triangular in planform. As is shown in FIG. 4, which illustrates the upstream end of the stratifier, the middle plate 52 has a triangle base edge of a width substantially equivalent to the diameter of the main line 10 while the upstream base edges of the plates 48, 50, 54 and 56 have a width corresponding to the corresponding chord length. As is best seen in FIG. 9, the vertices of the triangular plates terminate on a common diametral line corresponding to the upstream edge of the divider wall 26.

Each of the ducts 41–46 is bounded along one straight side by a portion of the inner surface of the pipe in which it is mounted and along its other side by a convergent side wall member formed integrally with one or the other of the corresponding ones of the plates 48–56. Thus, referring to FIG. 8, the top surface of the uppermost plate 48 is fitted along one convergent edge with a side wall member 60. In symmetrical fashion, as viewed in FIG. 9, the bottom side of the lowermost plate 56 is fitted along one convergent edge with a side wall member 62. In a similar alternating fashion one side only of each of ducts 42, 43, 44 and 45 is closed in along one convergent side only by a side wall member formed integrally with the corresponding plates, i.e. side walls 64–70. It wlll be appreciated that since, in the illustrated example of the invention, the stratifier structure is adapted to fit within a circular cross-section main distribution line, those edges of the side wall members 60–70 which are to fit in tight engagement against the inner surface of the pipe are shaped accordingly, i.e.; having the locus of a parabolic curve. It will also be apparent that the side wall members 60–70 may be formed integrally with the divider wall 26 as two sets of fingers struck out in opposite directions relative to the base web of the material.

As has been remarked, the turbulent flow 34 produced by the mixing means 22 is subject to a strong dynamic signal such that the liquid phase is biased in one or more directions radially of the main line 10 and there is not a uniform dispersion of the gas and water phases throughout the cross-section of the fluid. As will be evident from an examination of FIG. 4, each of the ducts 41–46 inducts a different chordal segment of the cross-section of the turbulent fluid 34. As indicated in FIG. 2, each of the ducts 41–46 is of an axial length adapted to induce laminar non-turbulent flow in the stratum of fluid passing downstream therethrough, e.g., a length on the order of about one pipe diameter. In order to average out or diffuse differences in the GLR of the several strata of fluid, alternate ones of the ducts 41–46 exhaust and combine to one side of the divider wall 26 while the other half of the ducts exhaust and combine to the other side of the divider wall. More particularly, the ducts 41, 43 and 45 exhaust to that side of the divider wall 26 which is in fluid communication with the side arm branch 20 of the Tee fitting 14 while the other set of ducts 42, 44 and 46 exhaust to that side of the divider wall in fluid communication with the straight through arm 16 of the Tee fitting. It will also be noted that the alternate fluid strata of each set emerging from the downstream side of the stratifier means 24 combine beyond an open convergent side of the duct plates to define streams 74 and 76 that are isolated from one another by the barrier of the divider wall 26.

The divider wall 26 comprises a straight section 78 and an offset or curved section 80 which are normal to the plane of the ducts 41–46. Thus, the straight section 78 has its upstream end integrally joined to the vertices of the triangular plates 48–56 to completely span the interior diameter of the pipe 10 and develops into the downstream offset end portion 80 which is arcuately configured to matingly engage the interior of the Tee fitting at the junction 82 of the downstream leg 16 and the downstream side of the side arm branch 20.

The stratifier arrangement of two vertically alternating sets of ducts tends to average out disparities in GLR between the several ducted strata of each set such that the downstream flows 74 and 76 tend to be homogeneous in GLR throughout their respective cross-sections. Further, the arrangement of two vertically alternating sets of horizontally disposed ducts immediately followed by the vertically disposed divider wall 26 produces a GLR of the side arm flow 74 of the two-phase fluid which has substantially the same GLR as the main line flow of two-phase fluid 76. In this connection, the divider wall 26 defeats the centripetal force signal generated by the flow of gas diverted into the side arm 20 such that the inertia of the liquid phase in the stream 76 is not affected by the centripetal force signal and continues downstream beyond the Tee fitting 14.

Figure 5:
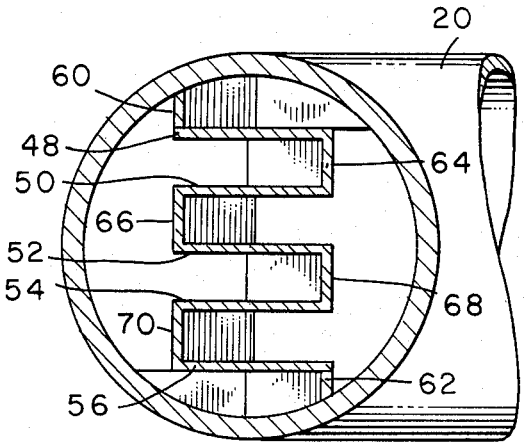
FIG. 5 is a sectional view taken on the line 5—5 of FIG. 2 showing a section of the stratifier downstream of its entrance end.
Figure 6:
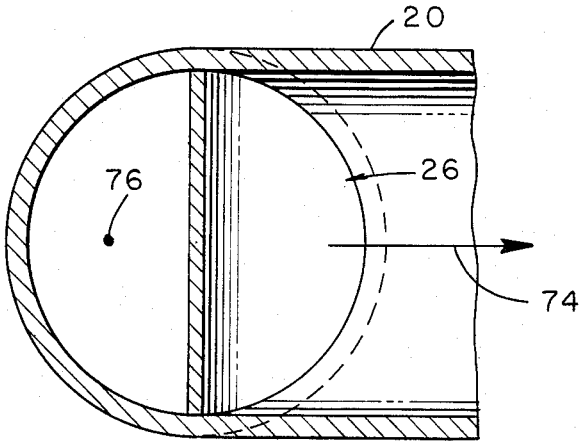
FIG. 6 is a section on the line 6—6 of FIG. 2 through a portion of the divider wall component of the invention.

Referring to FIG. 8, a top dam 84 and a bottom dam 86 are affixed to opposite sides of the straight section 78 of the divider wall 26 at the top and bottom ends of the upstream end of the wall. Each of the dams 84, 86 projects at substantially 90 degrees with respect to the plane of the divider wall and has an arcuate edge adapted to seat tightly against the corresponding confronting portion of the main pipe 10. As indicated in FIGS. 4 and 5, each of the dams 84, 86 has a shape and area to fully interfere with fluid exhausted linearly from the ducts 41 and 46, respectively. Thus, within the plane of the dams 84, 86 each of the dams defines a slight restriction in the passage of the two-phase fluid on the corresponding side of the divider wall 26, which aids in inducing laminar flow and the reduction of turbulence Additionally, the bottom dam 86 functions as a barrier to the free passage of any gravitationally induced accumulations of the liquid phase of the fluid behind it and any such accumulations which appear tend to be aspirated over the upper edge of the dam rather than proceeding downstream as a slug of the liquid phase.

In the use of the invention, while the main line 10 will generally be horizontally disposed, it may be desired in some pipeline networks to position the lateral lines 12 to extend upwardly or downwardly. In such cases, the offset portion 80 of the divider wall 26 may be warped upwardly or downwardly to a corresponding degree. Also, before installing a static mixer 10 of whatever form, it is preferred to first emperically determine an optimum angular position of the mixer relative to the plane of the ducts of the stratifier means 32, as well as the spacing, if any, between the downstream end of the mixer means 10 and the stratifier means 32. Thus, in the case of the illustrative King patent mixer shown in the drawings, it was emperically determined that for horizontally extending ducts 41–46 the particular embodiment of the King device shown should be positioned on the order of one pipe diameter upstream from the stratifier means and angularly adjusted to the position best seen in FIG. 9. The illustrated orientation of the components achieved a virtually ideal uniform GLR splitting of a two-phase mixture throughout a range of from about 20% to about 64% of gas inducted into a branch line.

While an exemplary embodiment of the invention has been described in detail, it will now be understood that the invention is capable of other embodiments and of being practiced and carried out in a variety of ways. Also, it should be understood that the phraseology and terminology employed herein is for the purpose of description and should not be regarded as limiting.

I claim:

1. An apparatus for uniformly distributing a two-phase fluid comprised of a gas phase and a liquid phase into a pair of branch streams of two-phase fluid, said apparatus comprising:

a conduit means for the fluid, said conduit means comprising an upstream branch having a downstream end that opens into first and second downstream flow-splitting branches of said conduit means;

a mixing means mounted within said upstream branch for dividing the two-phase fluid into a plurality of individual streams and then turbulently re-combining the individual streams;

a stratifier means mounted within said conduit means between said mixing means and said first and second branches of said conduit means for dividing the fluid exhausted by said mixing means into two sets of a plurality of alternate parallel strata of the fluid, said stratifier means comprising a multi-duct structure comprising a plurality of spaced-apart superposed parallel flat plates of substantially triangular configuration each of which plates has an upstream edge of a length to subtend said conduit means such that each stratum of fluid is bounded on a pair of opposite sides at said upstream edge by opposite side walls of said conduit means, said plates having downstream vertices disposed along a mid-line of said conduit means, each of the ducts of said multi-duct structure being bounded along one straight side of said duct by a straight side of said conduit means, each of said ducts on the side opposite to said on e side being bounded by a convergent wall means having a downstream end terminating at said mid-line along which said vertices of said plates are disposed such that said two sets of strata exhaust past said downstream end of said stratifier means on opposite sides thereof; and a divider wall means mounted within said conduit means between said downstream end of said stratifer means and said first and second downstream branches for defining an isolated pair of fluid flow passages for said two sets of strta from said downstream end of said stratifier means into said first and second branches.

2. An apparatus as in claim 1 in which:

said plates of said stratifier means are substantially horizontally disposed and said divider wall means comprises a vertically disposed imperforate wall having an upstream edge joined to said vertices of said plates along said mid-line.

3. An apparatus as in claim 2 in which:

said divider wall has a pair of dams affixed to opposite sides of said wall at the top and bottom ends of said upstream edge of said wall, each of said dams projecting at substantially ninety degrees with respect to the plane of said divider wall and defining and imperforate barrier in interfering alignment with fluids exhausted from corresponding ones of said ducts, each of said dams defining a restriction in the passage of fluid on the corresponding side of said divider wall whereby to induce laminar flow in the fluid passing thereby and functioning as a barrier to the free passage of any accumulations of liquid phase of the fluid behind the lower one of said dams.

* * * * *